US008220420B2

(12) United States Patent
Taylor et al.

(10) Patent No.: US 8,220,420 B2
(45) Date of Patent: Jul. 17, 2012

(54) DEVICE TO IMPROVE EFFECTIVENESS OF PULSE DETONATION CLEANING

(75) Inventors: Robert Warren Taylor, Ponte Vedra Beach, FL (US); David Chapin, Kansas City, MO (US); Terry Farmer, Kearney, MO (US); James Easel Roberts, Kansas City, MO (US)

(73) Assignee: General Electric Company, Schenectady, NY (US)

( * ) Notice: Subject to any disclaimer, the term of this patent is extended or adjusted under 35 U.S.C. 154(b) by 161 days.

(21) Appl. No.: 12/727,283

(22) Filed: Mar. 19, 2010

(65) Prior Publication Data

US 2011/0226284 A1 Sep. 22, 2011

(51) Int. Cl.

| | |
|---|---|
| ***F22B 37/48*** | (2006.01) |
| ***F23J 3/02*** | (2006.01) |
| ***F28G 1/00*** | (2006.01) |
| ***B08B 9/00*** | (2006.01) |

(52) U.S. Cl. .... 122/379; 122/396; 134/22.1; 134/166 R; 134/167 R; 15/316.1

(58) Field of Classification Search ..... 239/242
See application file for complete search history.

(56) References Cited

U.S. PATENT DOCUMENTS

| | | | | |
|---|---|---|---|---|
| 7,360,508 | B2 * | 4/2008 | Habib et al. | 122/379 |
| 7,585,343 | B2 | 9/2009 | Clements | |
| 2007/0051833 | A1 * | 3/2007 | Jager | 239/451 |
| 2008/0271685 | A1 * | 11/2008 | Lupkes et al. | 122/396 |

OTHER PUBLICATIONS

Search Report from corresponding GB Application No. GB1104124.1 dated Jul. 12, 2011.

* cited by examiner

*Primary Examiner* — Michael Kornakov
*Assistant Examiner* — Nicole Blan
(74) *Attorney, Agent, or Firm* — Pearne & Gordon LLP

(57) ABSTRACT

A system and associated method for removing accumulated debris from a surface of a vessel. The system includes an impulse cleaning device defining a combustion chamber in which combustible fuel and air are mixed and ignited to produce combustion that is directed at the surface to be cleaned within the vessel, and an eductor assembly surrounding a downstream end of the chamber for inducting surrounding atmosphere into the combustion to widen the area being cleaned.

15 Claims, 3 Drawing Sheets

DEVICE TO IMPROVE EFFECTIVENESS OF PULSE DETONATION CLEANING

BACKGROUND OF THE INVENTION

1. Field of the Invention

The invention relates generally to an impulse combustion cleaning system. More specifically, the invention relates to an eductor shield around the downstream end of a detonation chamber to increase the effectiveness of an impulse cleaning system.

2. Discussion of Prior Art

Various devices and systems that have a flow that contains particulate matter may require cleaning after some period of use. Some examples of such devices/systems include industrial boilers, gas to air heat exchangers, and other types of heat exchangers used in processing/manufacture of product such as cement. Focusing for the moment on the one example of industrial boilers, such boilers operate by using a heat source to create steam from water or another working fluid, which can then be used to drive a turbine in order to supply power. The heat source may be a combustor that burns a fuel in order to generate heat, which is then transferred into the working fluid via a heat exchange. Burning the fuel may generate residues that can be left behind on the surface of the combustor or heat exchanger. Such buildups of soot, ash, slag, or dust on heat exchanger surfaces can inhibit the transfer of heat and therefore decrease the efficiency of the system. Periodic removal of such built-up deposits maintains the efficiency of such boiler systems.

Pressurized steam, water jets, acoustic waves, and mechanical hammering have been used to remove built-up deposits. These systems can be costly to maintain and the effectiveness of these systems varies. Pressurized steam, water jets, and mechanical hammering in many instances damage the heat transfer surface.

A supersonic combustion or impulse cleaning system has recently been used in an attempt to remove built-up deposits. Supersonic combustion events create strong impulse waves that remove the build-up deposits and accumulated debris from the heat exchanger surfaces. A shock wave is very effective in fluidizing a dust buildup. Improving the effective cleaning area and the flushing action of a shock wave by a single device is a continuing goal. Therefore, there is a need for development of effective and reliable impulse cleaning systems having an improved cleaning area and flushing action.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

In accordance with one aspect, the present invention provides a system for removing accumulated debris from a surface of a vessel. The system includes an impulse cleaning device defining a combustion chamber in which combustible fuel and air are mixed and ignited to produce combustion that is directed at the surface to be cleaned within the vessel, and an eductor assembly surrounding a downstream end of the chamber for inducting surrounding atmosphere into the combustion to widen the area being cleaned.

In accordance with another aspect, the present invention provides a method for removing accumulated debris from a surface within a vessel. The method includes providing an impulse cleaning device defining a combustion chamber, delivering a flow of combustible fuel into the flow of air in the combustion chamber, mixing the combustible fuel and air within the combustion chamber, igniting the fuel and air mixture to produce combustion, directing the combustion at the surface to be cleaned to loosen and remove accumulated debris from the surface of the vessel and inducting surrounding atmosphere into the supersonic combustion via an eductor assembly surrounding a downstream end of the chamber to widen the area being cleaned.

BRIEF DESCRIPTION OF THE DRAWINGS

These and other features, aspects, and advantages of the invention will be better understood when the following detailed description is read with reference to the accompanying drawing, in which.

DETAILED DESCRIPTION OF THE INVENTION

Figure 1:
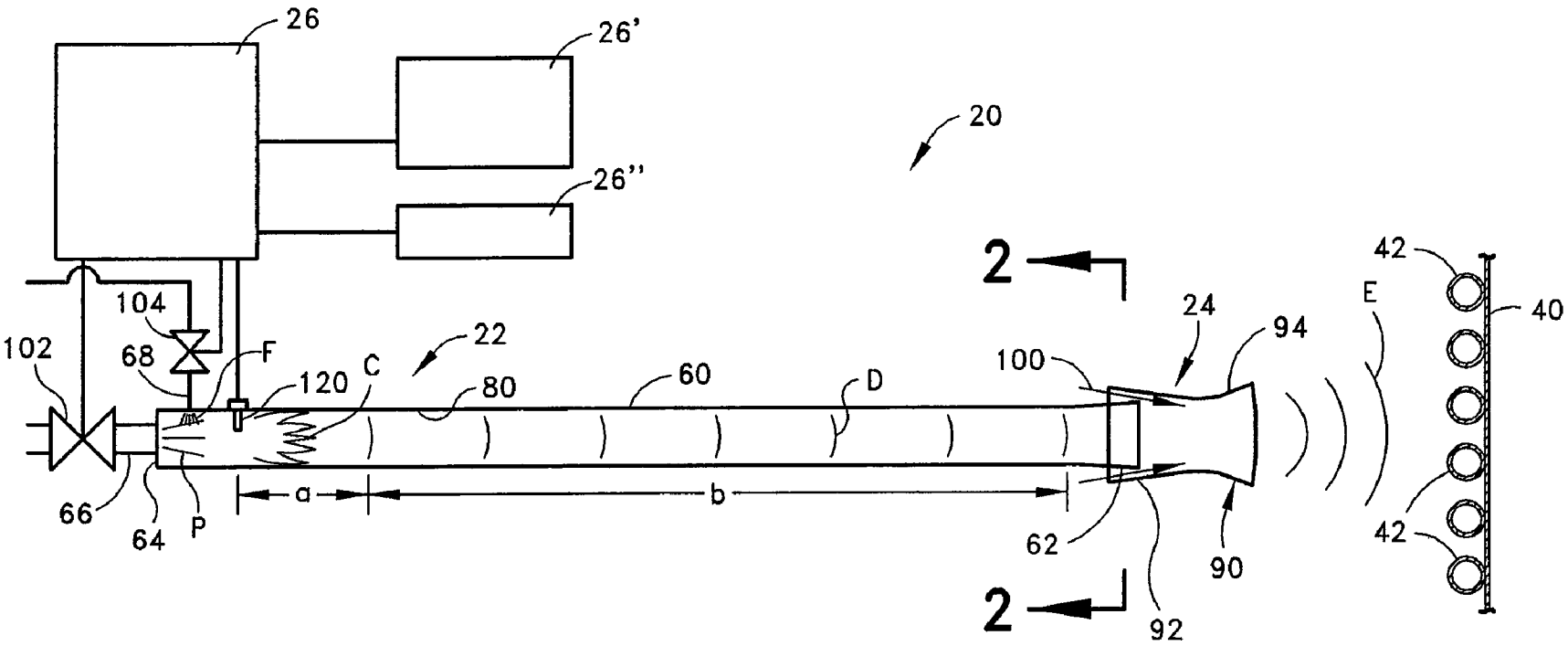
FIG. 1 is a schematic representation of an example impulse cleaning system according to at least one aspect of the invention.

Example embodiments that incorporate one or more aspects of the invention are described and illustrated in the drawings. These illustrated examples are not intended to be a limitation on the invention. For example, one or more aspects of the invention can be utilized in other embodiments and even other types of devices. Moreover, certain terminology is used herein for convenience only and is not to be taken as a limitation on the invention. Still further, in the drawings, the same reference numerals are employed for designating the same elements. The present invention is related to various devices and systems that have a flow that contains particulate matter may require cleaning after some period of use. Some examples of such devices/systems include industrial boilers, gas to air heat exchangers, and other types of heat exchangers used in processing/manufacture of product such as cement. Some of the discussion presented herein is provided in connection with the one example of industrial boilers. However, it is to be appreciated that the present invention need not be limited to a connection with industrial boilers and that the present invention may be used in connection with other devices/systems.

Soot or other buildup on heat exchanger surfaces in industrial boilers can cause losses in the overall efficiency of the boiler due to a reduction in the amount of heat that is actually transferred into a working fluid. This is often reflected by an increase in the exhaust gas temperature from the process, as well as an increase in the fuel-burn rate required to maintain steam production and a given energy output. A complete removal of buildup from the heat exchanger surfaces may require that the boiler to be shut down while a cleaning process is performed. However, such an approach clearly has at least the disadvantage of down time of the heat exchanger. As an alternative, online cleaning techniques generally have high maintenance costs or incomplete cleaning results. Traditionally, online cleaning techniques are utilized to maintain heat transfer flux rate. In many instances though, such online cleaning techniques cannot achieve satisfactory cleanliness of the heat transfer surface and off line cleaning is required. The present invention provides advantages and improvements over the known approaches.

In accordance with one aspect, an impulse cleaning system is associated with a boiler is used to generate a series of shock waves (e.g., via detonations or quasi-detonations) that are directed into a fouled portion of the boiler. The resulting impulse waves impact boiler surfaces and loosen buildup from the surfaces. The loosened debris is free to fall to the bottom of the boiler and then may exit the boiler through hoppers. It is also desirable that a cleaning system for a boiler be able to operate to quickly remove buildups in order to minimize the downtime for the boiler. An impulse-based cleaning system that can provide these and other features will be described in more detail below.

As used herein, the term "impulse cleaning system" will refer to a system that produces both a pressure rise and velocity increase from the detonation or quasi-detonation of a fuel and oxidizer. The impulse cleaning system can be operated in a repeating mode to produce multiple detonations or quasi-detonations within the device. These detonations or quasi-detonations form a pulse of energy in the form of a shock wave that can be used for cleaning built-up deposits and accumulated debris from surfaces of a boiler vessel. A "detonation" is a supersonic combustion event in which a shock wave is coupled to a combustion zone. The shock wave is sustained by the energy release from the combustion zone, resulting in combustion products at a higher pressure than the combustion reactants. A "quasi-detonation" is a supersonic turbulent combustion process that produces a pressure rise and velocity increase higher than a pressure rise and velocity increase produced by a sub-sonic deflagration wave. For simplicity, the term "detonation" as used herein will be meant to include both detonations and quasi-detonations.

Example impulse cleaning systems, some of which will be discussed in further detail below, include an ignition device for igniting a fuel/oxidizer mixture, and a detonation chamber or zone in which pressure wave fronts initiated by the combustion coalesce to produce a detonation wave. Each detonation is initiated either by an external ignition source, such as a spark discharge, laser pulse heat source, or plasma igniter, or by gas dynamic processes such as shock focusing, auto ignition or an existing detonation wave from another source (cross-fire ignition). The detonation chamber geometry allows the pressure increase behind the detonation wave to drive the detonation wave and also to blow the combustion products out of the impulse cleaning system.

Various chamber geometries can support detonation formation, including round chambers, tubes, resonating cavities and annular chambers. Such chambers maybe of constant or varying cross-section, both in area and shape. Example chambers include cylindrical tubes and tubes having polygonal cross-sections, such as, for example, hexagonal tubes or including obstacles to promote detonation.

One embodiment of an example impulse cleaning system 20 suitable for use with an industrial boiler is illustrated schematically in FIG. 1. The impulse cleaning system 20, according to one aspect of the invention, includes an impulse cleaning device 22 and an eductor assembly 24. In another aspect of the invention, the impulse cleaning system 20 also includes a controller/monitor 26.

The impulse cleaning device 22 is constructed and mounted such that it can direct shock waves or cleaning pulses of energy at a wall 40 of a boiler vessel. In one example, a plurality of tubes 42 are located in the boiler vessel and are supported by the wall 40. Thus, the cleaning pulses of energy are also directed at the tubes 42. The wall 40 and tubes 42 tend to have soot or other buildup resulting from a combustion process in the boiler vessel that can cause losses in the overall system efficiency due to a reduction in the amount of heat that is actually transferred into a working fluid flowing through the tubes.

The impulse cleaning device 22 has a tubular body 60 that, extends longitudinally with an open "horn" end 62 directed at the wall 40 and tubes 42 of a boiler vessel to be cleaned. The body 60 has an opposite closed head end 64 and at least one air inlet port(s) 66 and at least one fuel inlet port(s) 68. Although multiple ports may be provided for the air and fuel inlet, only a single port for each of air and fuel is discussed for ease of reference. The body 60 defines a combustion chamber 80 that has a deflagration zone "a" and a detonation zone "b".

The head end 64 of the impulse cleaning device 22 has its air inlet port 66 connected to a source of air that can be provided under pressure through a valve 102 to deliver a flow of air P to the combustion chamber 80. This air source is used to fill and purge the combustion chamber 80, and also provides air to serve as an oxidizer for the combustion of the fuel. The air inlet port 66 may be connected to a facility air source such as an air compressor (not shown).

The fuel inlet port 68 is located at the head end 64 of the impulse cleaning device 22 and extends in a direction transversely relative to the air inlet port 66. The fuel inlet port 68 is connected to supply a flow of fuel F to the combustion chamber 80 through valve 104. The fuel F will be burned within the combustion chamber 80. The fuel F that is supplied to the combustion chamber 80 is mixed with the flow of air P.

The mixing of the fuel F and air P may be enhanced by the relative arrangement of air inlet port 66 and the fuel inlet port 68. For example, if plurality fuel inlet ports are utilized such ports may be provided around the periphery of the combustion chamber 80. By placing the fuel inlet port 68 at a location such that fuel F is injected into regions of high turbulence generated by the flow air P, the fuel and air may be more rapidly mixed to provide a more readily detonatable fuel/air/mixture. As with the air inlet port 66, the fuel inlet port 68 may be disposed at a variety of axial and circumferential positions. The fuel inlet port 68 may be aligned to extend in a purely radial direction, or may be canted axially or circumferentially with respect to the radial direction.

Fuel F is supplied to the fuel inlet port 68 through the valve 104 that controls when fuel is allowed into the combustion chamber 80 of the impulse cleaning device 22. The valve 104 may be disposed within the fuel inlet port 68, or may be disposed upstream in a supply line that is connected to the fuel inlet port. The valve 104 may be a solenoid valve and may be controlled electronically by the controller 26 to open and close in order to regulate the flow of fuel F into the combustion chamber 80. The controller 26 may also electronically control the valve 102 and the flow of air P to the combustion chamber 80.

It may be desirable to use the valve 104 to control the introduction of fuel F into the impulse cleaning device 22 by means of the controller 26. It may also be desirable to control the air flow P for times when the cleaning system 20 is not operating. The controller 26 can track the amount of time that has passed since the opening of a fuel valve 104. Based upon the rate of air input to the impulse cleaning device 22, the controller 26 can close the fuel valve 104 once a sufficient amount of fuel F has been added that the fuel/air mixture has filled the desired portion of the combustion chamber 80.

As illustrated in FIG. 1, an ignition device 120 is located near the head end 64, or opposite end, of the impulse cleaning device 22. In the illustrated embodiment, the ignition device 120 ignites the fuel/air mixture to create combustion C in the deflagration zone a. The ignition device 120 may take various forms. In particular, the ignition device 120 need not produce immediate detonation of the fuel/air mixture in every embodiment. However, the ignition device 120 provides sufficient energy for ignition that allows the combustion of the fuel/air mixture which can transition to a supersonic shock wave D, within the detonation zone b of the combustion chamber 80. The ignition device 120 may be connected to the controller 26 to operate the ignition device at desired or periodic times.

The controller 26 may be of any suitable type or combination of components to control the timing and operation of various systems, such as the valves 102, 104 and ignition device 120. For example the controller 26 may include a processor, a microprocessor, a microcontroller, a programmable logic controller, an application specific integrated circuit, other programmable circuits suitable for such purposes and software or any suitable combination thereof. Also as used herein, the term controller 26 may broadly include additional aspects, such as a master networked computer 26' and operative connection thereto. Also, still other aspects/features/components may broadly be included within the controller 26. Such other aspects/features/components may be optional and may include indicators, alarms, or the like. Such, other aspects/features/components are generically represented by 26" and operative connection thereto. The controller 26 may also control other aspects/functions. For example, another embodiment subsequently described herein may include control of functions/aspects via the controller 26.

The impulse cleaning device 22, constructed according to one aspect as illustrated in FIG. 1, includes the elongate tubular body 60 defining the combustion chamber 80 that extends from the head end 64 to the horn end 62. Combustion of the fuel/air mixture takes place within the combustion chamber 80. In general, the combustion C will progress from the ignition device 120 through the mixture that is within the combustion chamber 80. FIG. 1 illustrates a cross-section of body 60 in the shape of a substantially round cylinder having a constant cross-sectional area. It will be apparent that other configurations of the body 60 and combustion chamber 80 are possible.

The body 60 may contain a number of obstacles (not shown) in the combustion chamber 80 disposed at various locations along the length of the body. The obstacles are used to enhance the combustion as it progresses along the length of the body 60, and/or to accelerate the combustion front C into a supersonic shock wave D before the combustion front reaches the horn end 62 at the downstream end of the body. The body 60 and obstacles may be fabricated using a variety of materials suitable for withstanding the temperatures and pressures associated with the repeated detonations. Such materials include but are not limited to: Inconel, stainless steel, aluminum and carbon steel.

The cleaning system 20 incorporating the impulse cleaning device 22 uses supersonic shock waves D that form cleaning energy to loosen accumulated debris, deposits and coatings that can accumulate on the walls 40 and tubes 42 of a boiler vessel or other device. High pressure fluid flow that follows the detonation helps blow the loosened material away from the cleaned surfaces. In operation, the impulse cleaning device 22 creates a supersonic shock wave D and its associated high-pressure flow from a combustion cycle, which is preferably repeated at high frequency. The impulse cleaning device 22 can operate at frequencies of less than 1 Hz up to 100 Hz. Each combustion cycle generally includes a fill phase, an ignition event, a flame acceleration into detonation or supersonic phase, and a blowdown phase.

A single occurrence of a fuel fill phase, a combustion ignition, an acceleration of the flame front to supersonic, and the blow down and purge of the combustion products will be referred to as "a combustion cycle" or "a detonation cycle". The portion of time that the impulse cleaning system 20 is active is referred to as "cleaning operation". Time when the vessel to be cleaned is being actively used for its purpose will be referred to as "boiler operation". As noted above, the parts to be cleaned need not be part of a boiler vessel; however, for simplicity of reference, the term "boiler operation" will be used to refer to the operation of any device being cleaned by the cleaning system 20.

One advantage of the cleaning system 20 is that, unlike other cleaning systems, there is no need to shut down the boiler vessel or other parts being cleaned in order to operate the cleaning system. Specifically, it is possible for the cleaning operation to take place during the boiler operation. An additional advantage relates to the non destructive nature of the shock wave to the vessel. The pulse does not damage the surface of the heat transfer medium thus allowing more frequent operation compared to conventional methods. The cleaning system 20 need not be run continuously during the boiler operation. However, by providing the flexibility to operate the cleaning system on a regular cycle during boiler operation, an overall higher level of cleanliness can be maintained without significant downtime in boiler operation.

The ignition device 120 is controlled to initiate the combustion of the fuel/air mixture within the combustion chamber 80. If, for example, a spark initiator is used as the ignition device 120, the controller 26 sends electrical current to the spark initiator to create a spark at a predetermined time. In general, the ignition device 120 delivers sufficient energy into the mixture near the ignition device to form an expanding combustion front C in the fuel/air mixture. As this combustion front C consumes the fuel by burning it with the oxidizer present in the mixture, the combustion flame will propagate through the mixture within the combustion chamber 80.

As the combustion front C propagates through the combustion chamber 80 of the impulse cleaning device 22, the combustion front will reach the walls of the body 60 and any obstacles that are disposed within the combustion chamber. The interaction of the combustion front C with the walls of the body 60 and the obstacles will tend to generate an increase in pressure and temperature within the combustion chamber 80. Such increased pressure and temperature tend to increase the speed at which the combustion front C propagates through the combustion chamber 80 and the rate at which energy is released from the fuel/air mixture by the combustion front. This acceleration continues until the combustion speed raises above that expected from an ordinary deflagration process in the deflagration zone to a speed that characterizes a quasi-detonation or detonation in the detonation zone b. This deflagration to detonation process desirably takes place rapidly (in order to sustain a high cyclic rate of operation), and so the obstacles are used to decrease the run-up time and distance that is required for each initiated flame to transition into a detonation.

The detonation or supersonic shock wave D travels down the length of the body 60 and out of the horn end 62 as cleaning energy. From the horn end 62, the cleaning energy may be directed at the object to be cleaned, such as the wall 40 and tubes 42. High pressure combustion products follow the supersonic shock wave D and flow through the horn end 62.

As the high-pressure products blow out of the impulse cleaning device 22, the continued supply of air flow P through the air inlet port 66 will tend to push the combustion products downstream and out of the horn end 62. Such continued supply of air flow P is used to purge the combustion products from the body 60 of the impulse cleaning device 22. Once the combustion products are purged, the valve 104 for the fuel inlet port 68 is opened, and a new fill phase may be started to begin the next combustion cycle.

The impulse cleaning device 22 can be controlled by the controller 26 to produce multiple supersonic shock waves D in rapid succession. The supersonic shock wave D that exits from the horn end 62 includes an abrupt pressure increase, as cleaning energy, which will impact the parts of the object to be cleaned such as the wall 40 and tubes 42 of the boiler vessel. This cleaning energy has several beneficial effects by breaking up accumulated debris and slag from the wall 40 and tubes 42 of the boiler vessel.

In one aspect, the cleaning energy can produce pressure waves that travel through the accumulated slag and debris. Such pressure waves can produce flexing and compression within the accumulations that can enhance crack formation within the debris and break portions of the debris away from the rest of the accumulation, or from the wall 40 and tubes 42 of the boiler vessel. This is often seen as "dust" that is liberated from the surface of the accumulated slag.

In addition, the pressure change associated with the passage of the cleaning energy can produce flex in the walls of the boiler itself, which can also assist in separating the slag from the wall 40 and tubes 42 of the boiler vessel. The repeated impacts from the cleaning energy of repeating combustion cycles may excite resonances within the slag that can further enhance the internal stresses experienced and promote the mechanical breakdown of the debris. The repeated action of shock and purge is used to dislodge build-up that accumulates upon the wall 40 and tubes 42 of the boiler vessel.

It is important that the impulse cleaning system 20 be properly operating during boiler operation. The impulse cleaning device 22 may be located in an area that is either visually or audibly inaccessible by an operator or attendant so that verifying operation of the impulse cleaning device is not possible.

Figure 3:
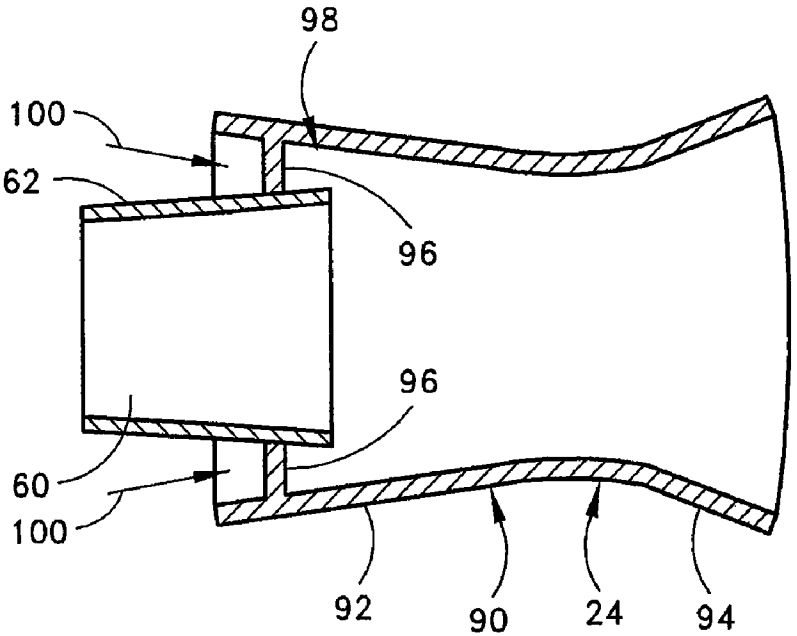
FIG. 3 is a cross sectional view taken along line 3-3 in FIG. 2.
Figure 2:
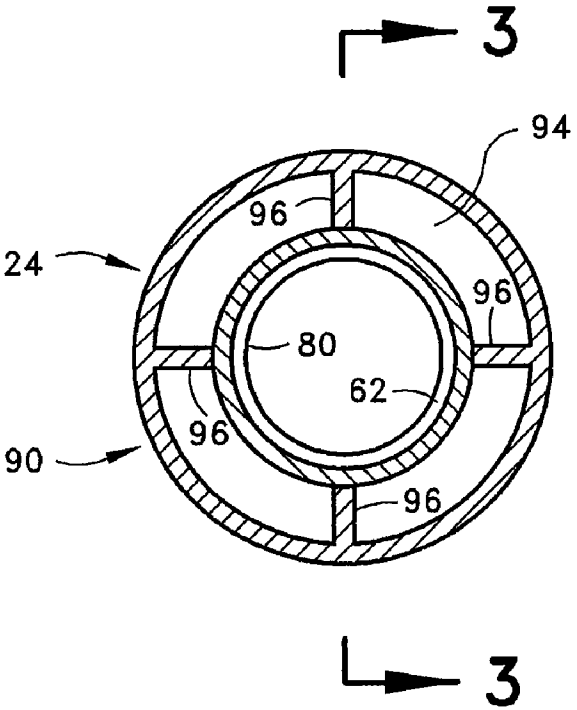
FIG. 2 is an enlarged cross sectional view taken along line 2-2 in FIG. 1 and shows details of an example impulse cleaning device.

According to an aspect of the invention illustrated in FIGS. 1-3, the horn end 62 of the body 60 is provided with the eductor assembly 24. In the shown example, the eductor assembly 24 is in the form of a nozzle 90 having a convergent portion 92 and a divergent portion 94. However, the nozzle may be shaped differently. For example, the nozzle could be straight (e.g., non-convergent) and then divergent. In general, it should be appreciated that the shapes, contouring, dimensions, etc. may be varied and the shapes, contours, relative dimensions within the shown examples are not specific limitations. To indicate this point further, it should be noted that it is even contemplated that the surfaces may have sophistication greater than as shown. For example it is possible to curl out the inlet of the eductor such that surface is rolled to be smooth for efficiency of flow.

The eductor assembly 24 is concentrically mounted on the horn end 62 of the body 60 by radial fins 96. The eductor assembly 24 surrounds a downstream end of the combustion chamber 80. Upon pulse detonation, a venturi 98 (FIG. 3) is created at the horn end 62 of the body 60. At each detonation, high velocity gasses pass through the venturi 98 to induce gas surrounding the venturi 98 into the eductor assembly 24, as indicated by the arrows 100. The eductor assembly 24 inducts surrounding atmosphere into the supersonic combustion to widen the area being cleaned.

The provision of the eductor assembly 24 increases the effective cleaning radius of the pulse detonation, specifically the blowdown of the high pressure products following the shock wave. As a result, it is possible to use fewer impulse cleaning devices to accomplish needed cleaning. Or another way to consider this advantage is that the same number of impulse cleaning devices will clean a larger area. Or yet another way to consider this advantage is that the shock wave is followed by a larger rush of air to brush way more of the deposits fractures by the shock wave. Thus a large volume of cleaning flow travels at high speed and engages the surface(s) to be cleaned.

Figure 4:
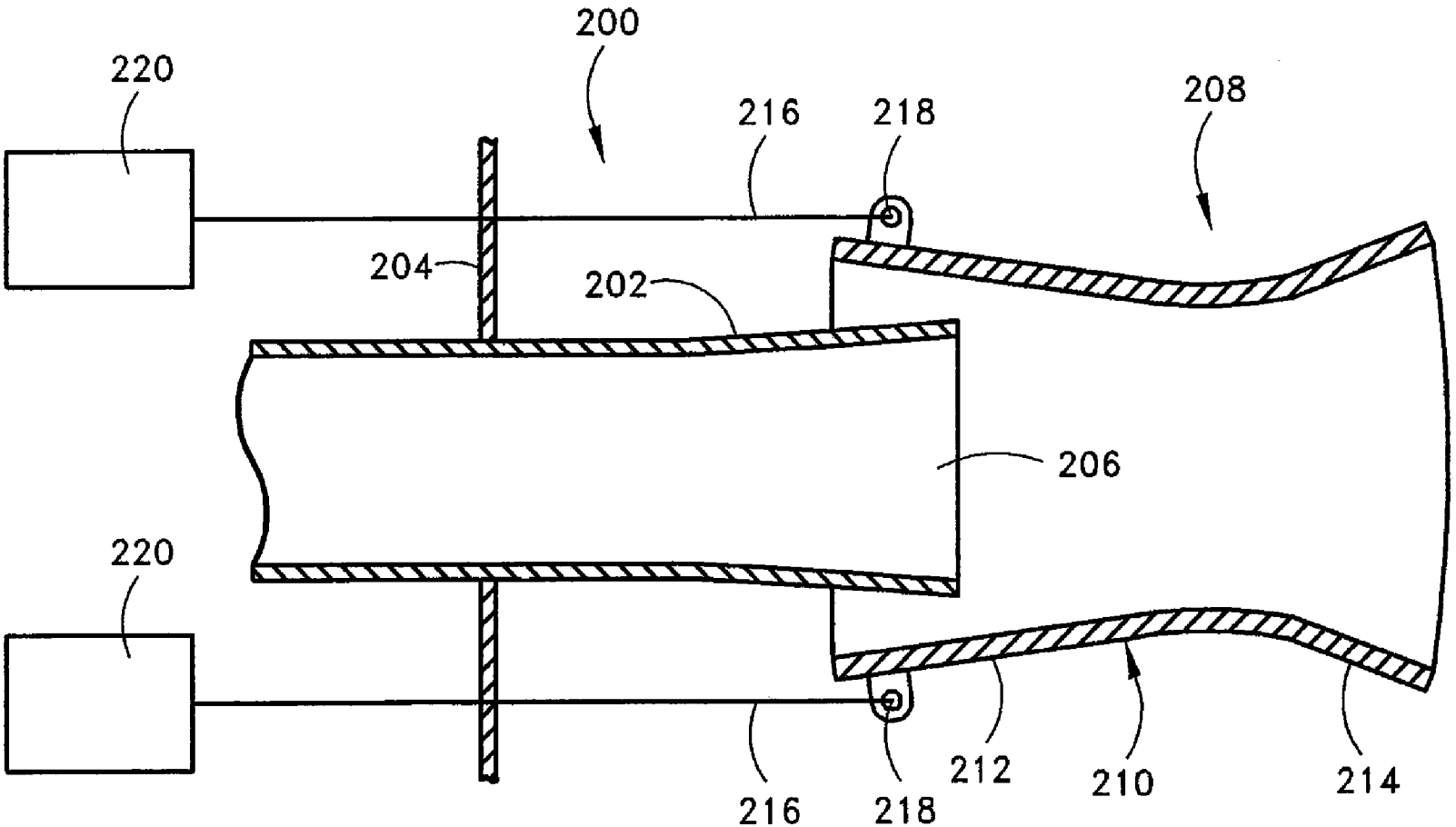
FIG. 4 is a schematic representation of a portion of another example of an impulse cleaning system, with another example of an impulse cleaning device, according at least one other aspect of the invention.

Another embodiment of an impulse cleaning device 200, according to another aspect of the present invention is illustrated in FIG. 4. The impulse cleaning device 200 is generally similar to the impulse cleaning device 22 illustrated in FIG. 1 and has a body 202 extending through a boiler wall 204, a horn end 206 of the body 202 is provided with an eductor assembly 208. The eductor assembly 208 is in the form of a nozzle 210 having a convergent portion 212 and a divergent portion 214.

In the shown example, the nozzle 210 is supported by two equally spaced (i.e., 180° apart) actuator arms 216 connected to the nozzle 210 by pivot pins 218. However, it is to be appreciated that an arrangement that has a different number of actuator arms, including a single arm, may be utilized. In the shown example, a second pair of arms (thus a total of four arms), positioned between the two shown arms may be provided. The four arms would thus be spaced at 90° intervals around the circumference of the nozzle). A drive mechanism 220 is provided for each actuator arm 216. Each drive mechanism 220 may be powered hydraulically, electrically or manually to enable the nozzle 210 to be manipulated in a conical path, side-to-side or up and down (FIG. 4 schematically represents either of such planes of movement). Each drive mechanism 220 can function based on a pre-programmed pattern, or activated manually based on heat transfer surface temperatures. According to this aspect of the invention the articulated nozzle directs the pulse detonation to an even broader cross section of the heat transfer surfaces. It is contemplates that actuator arm control may be incorporated into the controller 26. As such, the position of the venturi may be controlled via the controller 26. In this manner, the detonation pulses can be coordinated with the movement of the venturi section.

The various embodiments of the impulse cleaning system described above thus provide a way to achieve soot or ash removal from the wall and tubes of the boiler vessel. These techniques and systems also allow for periodic operation without the need to shut down the device being cleaned for extended periods of time.

It will be appreciated that the presented impulse cleaning system is not limited to use with industrial boilers, but may be used to provide cleaning on a variety of different surfaces which may experience fouling or accumulation of debris. Examples of vessels having surfaces which may be cleaned using the systems and techniques described herein include, but are not limited to: vessels used in cement production, waste-to-energy plants, and coal-fired energy facilities, as well as reactors in coal gasification plants.

Although the systems herein have been disclosed in the context of certain preferred embodiments and examples, it will be understood by those skilled in the art that the invention extends beyond the specifically disclosed embodiments to other alternative embodiments and/or uses of the systems and techniques herein and obvious modifications and equivalent thereof. Thus, it is intended that the scope of the invention disclosed should not be limited by the particular disclosed embodiments described above, but should be determined only by a fair reading of the claims that follow.

What is claimed is:

1. A system for removing accumulated debris from a surface of a vessel, the system including:

an impulse cleaning device defining a combustion chamber in which combustible fuel and air are mixed and ignited to produce combustion that is directed at the surface to be cleaned within the vessel; and an eductor assembly surrounding a downstream end of the chamber and spaced from the downstream end of the chamber to define an ambient atmosphere flow path for inducting surrounding atmosphere inside the educator assembly and into the combustion to widen the area being cleaned.

2. The system of claim 1 wherein, the eductor assembly is in the form of a nozzle.

3. The system of claim 2, wherein the nozzle has a converging portion and a diverging portion.

4. The system of claim 3, wherein the nozzle is axially aligned with and fixed to the combustion chamber.

5. The system of claim 4, wherein the nozzle is fixed to the combustion chamber by radial fins.

6. The system of claim 4, wherein a downstream end of the combustion chamber diverges to form a horn end.

7. The system of claim 2, wherein the nozzle is supported by at least one actuating arms pivotally connected to the nozzle.

8. The system according to claim 7, wherein the actuating arms extend through a wall of a boiler vessel.

9. The system of claim 2, wherein the nozzle is supported by at least two actuating arms pivotally connected to the nozzle.

10. The system of claim 1, wherein the combustion is supersonic combustion.

11. A method for removing accumulated debris from a surface within a vessel, the method including:

providing an impulse cleaning device defining a combustion chamber;

delivering a flow of combustible fuel into the flow of air in the combustion chamber;

mixing the combustible fuel and air within the combustion chamber;

igniting the fuel and air mixture to produce combustion;

directing the combustion at the surface to be cleaned to loosen and remove accumulated debris from the surface of the vessel; and inducting surrounding atmosphere into the combustion via an eductor assembly surrounding a downstream end of the chamber and spaced from the downstream end of the chamber to define an ambient atmosphere flow path so that the ambient atmosphere flow is inducted inside the educator assembly to widen the area being cleaned.

12. The method of claim 11, wherein induction of the surrounding atmosphere is caused by a nozzle fixed to a downstream end of the combustion chamber.

13. The method of claim 11, wherein the nozzle is fixed to the combustion chamber by radially extending fins.

14. The method of claim 11, wherein actuating arms are sequentially operated to move the nozzle in conical path.

15. The method of claim 11, wherein the combustion is supersonic combustion.

* * * * *